United States Patent [19]

Sanchez et al.

[11] Patent Number: 4,821,950

[45] Date of Patent: Apr. 18, 1989

[54] LIQUID CONTAINER OPENING DEVICE

[76] Inventors: Aracelia Sanchez; Don O. Cord, both of 800 Hudson Ave., Sarasota, Fla. 34236

[21] Appl. No.: 208,652

[22] Filed: Jun. 20, 1988

[51] Int. Cl.[4] ..... B65D 5/42

[52] U.S. Cl. ..... 229/160.2; 206/617; 206/628; 206/631.3; 206/633

[58] Field of Search ..... 229/125.42, 160.2, 137; 206/616, 617, 628, 631.3, 621.1, 621.2, 621.3, 633

[56] References Cited

U.S. PATENT DOCUMENTS

| | | | |
|---|---|---|---|
| 2,315,116 | 3/1943 | Flizikowski | 206/616 |
| 2,353,746 | 7/1944 | Moore | 206/617 |
| 3,074,610 | 1/1963 | Pugh | 206/631.3 |
| 3,426,936 | 2/1969 | Palmer | 206/616 |
| 3,520,464 | 7/1970 | Pugh, Sr. | 229/160.2 |
| 3,567,108 | 3/1971 | Corridon | 206/633 |
| 3,617,311 | 11/1971 | Beltle | 206/616 |
| 4,441,613 | 4/1984 | Hain et al. | 206/628 |

FOREIGN PATENT DOCUMENTS

| | | | |
|---|---|---|---|
| 2229935 | 1/1974 | Fed. Rep. of Germany | 206/617 |
| 2650092 | 5/1978 | Fed. Rep. of Germany | 206/616 |
| 2734250 | 2/1979 | Fed. Rep. of Germany | 206/617 |
| 8203370 | 10/1982 | PCT Int'l Appl. | 206/631.3 |
| 1441426 | 6/1976 | United Kingdom | 206/621.3 |
| 2133776 | 8/1984 | United Kingdom | 206/617 |

*Primary Examiner*—Stephen Marcus
*Assistant Examiner*—Gary E. Elkins
*Attorney, Agent, or Firm*—Charles J. Prescott

[57] ABSTRACT

An improved, easily openable rectangularly-shaped container for liquids such as milk and juice formed of folded sheet paper or plastic, the improvement comprises the addition of an opening device having a first portion connected to the sealed pour spout and a second position integral with the first portion which extends free from the pour spout adapted for hand grasping. The first portion, when the second portion is pulled away from the pour spout, separates the sealed mating upper margins of the pour spout. The improvement may also be detachable after initial opening of the container.

5 Claims, 2 Drawing Sheets

FIG. 5
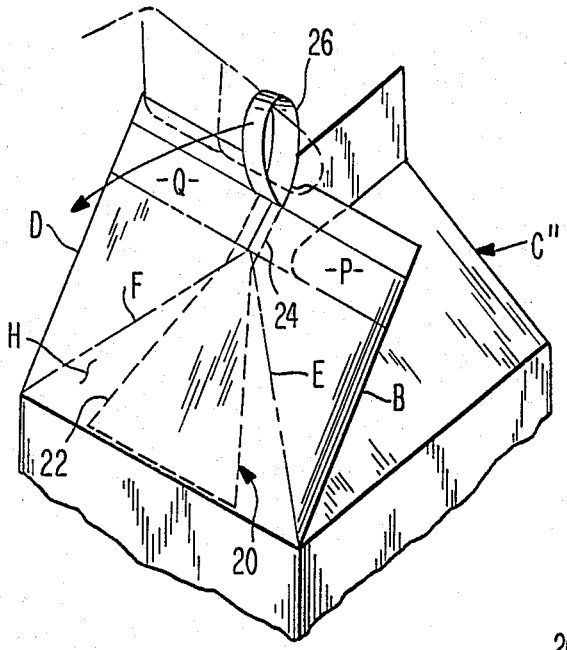
FIG. 6
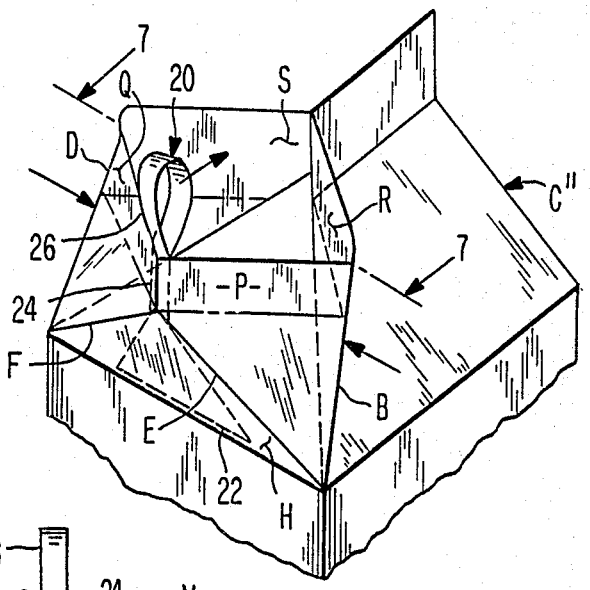
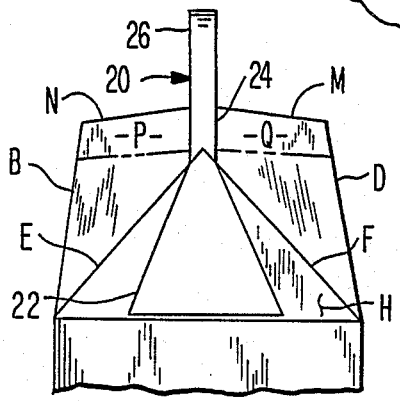
FIG. 7
FIG. 8
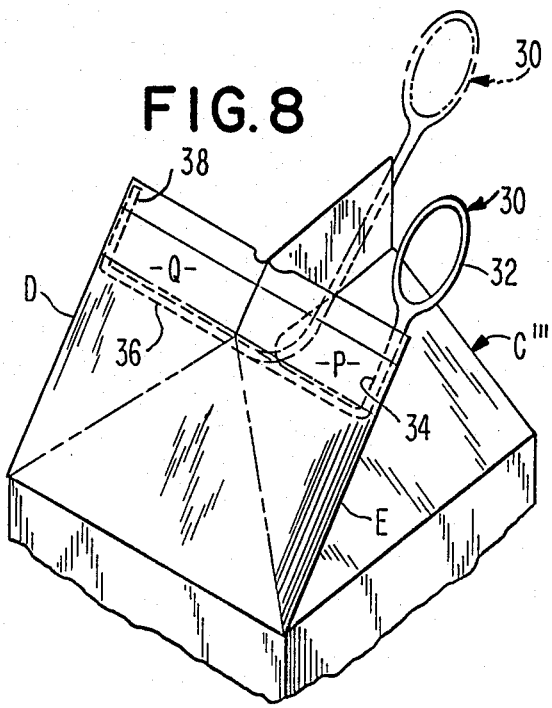
FIG. 9
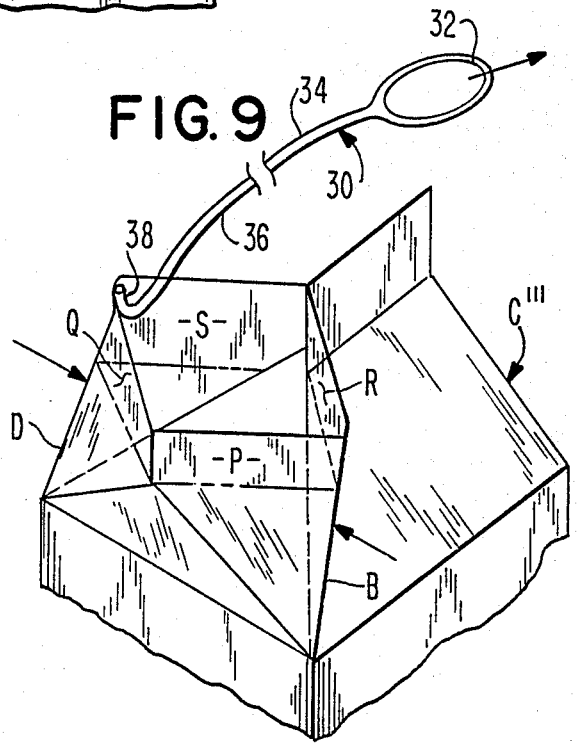

LIQUID CONTAINER OPENING DEVICE

BACKGROUND OF THE INVENTION

This invention relates generally to disposable liquid containers, and more particularly to an improvement in well-known rectangularly shaped containers for liquids such as milk and juice formed of folded sheet paper or plastic material.

One of the most widely used containers for liquids such as milk, juice and the like is the well-known rectangularly shaped folded paper container. Alternately, some of these more durable containers are fabricated of folded thin plastic materials. These containers are generally cylindrically shaped having a square transverse perimeter and wherein the upper ends are folded closed to form both carrying recesses and an integrally formed pour spout which is made available after the container is opened.

These well-known paper liquid containers are also infamous for their "openability". The first step in the opening process is to separate the diagonally disposed opposing side panels which, after opening, serve as a portion of the pour spout. Although these surfaces are adhered together, this initial step is quite simple. Thereafter, fingernails, a knife or the like must be utilized to separate the mating, adhered upper margins of the pour spout. It is this step which typically enrages mot users of these containers, many of whom resort to machetes.

The paper panel structure of these containers enhances the difficulty of effecting this second step because, following the first step, the exposed outer surface of the upper margin of the pour spout is somewhat mutilated. Applying fingernails, knives or the like to effect separation between the still adhered inner surfaces of the upper margin of the pour spout is extremely difficult at best.

The present invention provides an improved container as above described which incorporates and includes an opening device which quickly and easily facilitates this second step in the opening process whereby the adhered mating upper margins of the pour spout are quickly and easily separated from one another without further mutulation of the pour spout.

BRIEF SUMMARY OF THE INVENTION

This invention is directed to an improved, easily openable rectangularly-shaped container for liquids such as milk and juice formed of folded sheet paper or plastic, the improvement comprises the addition of an opening device having a first portion connected to the sealed pour spout and a second portion integral with the first portion which extends free from the pour spout adapted for hand grasping. The first portion, when the second portion is pulled away from the pour spout, separates the sealed mating upper margins of the pour spout. The improvement may also be detachable after initial opening of the container.

It is therefore an object of this invention to provide an improved, easily openable paper or plastic rectangularly shaped liquid container for milk, juices and the like.

It is another object of this invention to provide an improved, easily openable paper or plastic rectangularly shaped liquid container for milk, juices and the like in which the opening device may be made removable for continued use of the container.

It is yet another object to provide the above invention which is economical in its various forms and readily adaptable to existing paper and plastic rectangularly shaped containers without modification, except for the addition of the present invention thereto.

In accordance with these and other objects which will become apparent hereinafter, the instant invention will now be described with reference to the accompanying drawings in which:

BRIEF DESCRIPTION OF THE DRAWINGS

FIG. 5 is a perspective view of FIG. 1 shown after the first stage of opening the container including the preferred embodiment of the opening device.

FIG. 6 is a perspective view of FIG. 5 after the container is fully opened, the pour spout is in position for use, and also depicting the removal of the opening device of the opening device therefrom in phantom.

FIG. 7 is a view in the direction of arrows 7—7 in FIG. 6.

FIG. 8 is a perspective view of after the first stage of opening the container including another embodiment of the opening device and depicting the operation of the opening device in phantom.

FIG. 9 is a perspective view of FIG. 8 after the opening device has been used and the pour spout is in its fully open configuration depicting removal of the opening device therefrom.

DETAILED DESCRIPTION OF THE INVENTION

Figure 1:
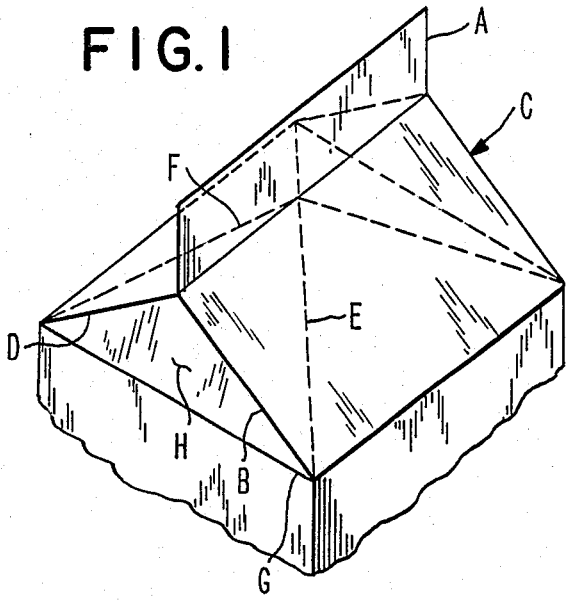
FIG. 1 is a perspective view of the top portion of a conventional paper or plastic rectangularly shaped container for milk, juice and the like in its closed position, all embodiments of the invention to be included therein.

Referring now to the drawings, and particularly to FIG. 1, the top portion a conventional folded paper or plastic rectangularly shaped container C is there shown in its sealed closed configuration. Opposing cylindrical sides are folded diagonally and sealed to form upwardly extending top portion A and the remainder of this well-known container C including its pour spout is thereby formed as shown. In the closed configuration, opposing recesses are formed below panel A, one of which forms the pour spout of the container C. The pour spout is thus formed by panel H folded along G and further bounded by panels defined by folds B, D, E and F as shown.

Figure 2:
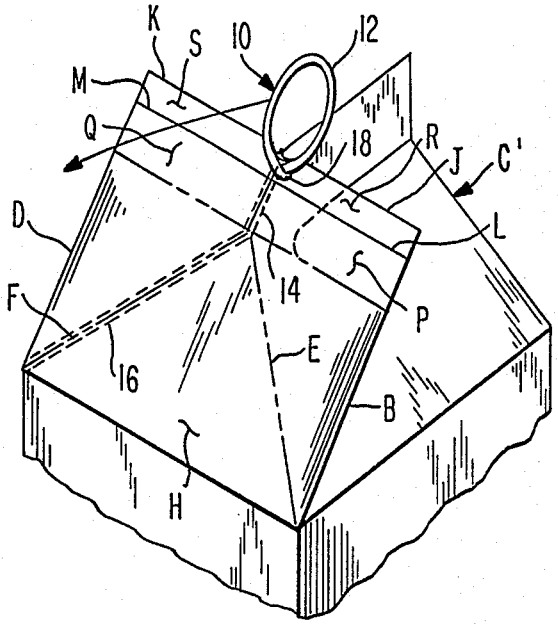
FIG. 2 is a perspective view of FIG. 1 shown after the first stage of opening the container including one embodiment of the opening device.
Figure 3:
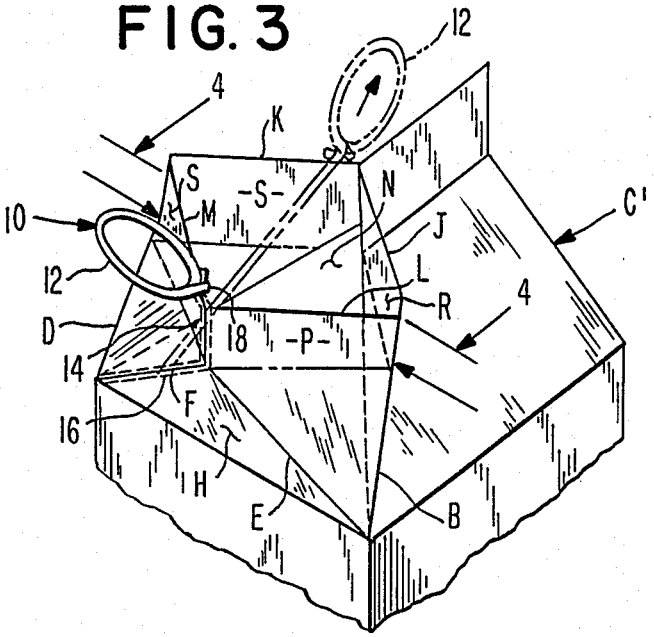
FIG. 3 is a perspective view of FIG. 2 after the container is fully opened, the pour spout is in position for use, and also depicting the removal of the opening device of the opening device therefrom in phantom.
Figure 4:
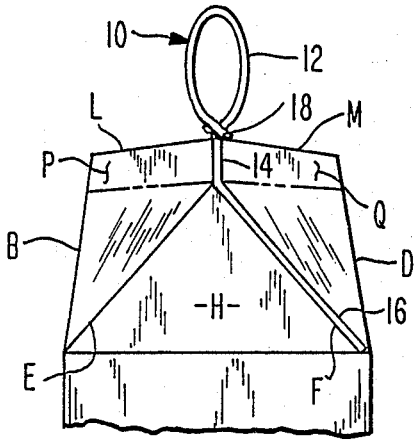
FIG. 4 is a view in the direction of arrows 4—4 in FIG. 3.

Referring now to FIG. 2, 3 and 4, the container modified in accordance with one embodiment of the invention is there shown at C'. It should be here noted that, to both assist in sealing the container closed and also to assist in opening same, margins J and K of the pour spout slightly extended beyond opposing margins L and M. Thus, during final sealing of the container after the contents have been placed therein, an adhesive is placed on panels R and S and on both inner and outer surfaces of panels P and Q. By this arrangement, the container is fully sealed and, finally the spout is sealed closed to form panel A as shown in FIG. 1 transversely across the entire width of the container. To open the container for use, the first stage of opening requires the separation of margins B and D into the orientation shown in FIG. 2. Thereafter, panels P/R and Q/S must be forced apart to release the seal there between to allow opening of the spout in the configuration shown in FIG. 3.

The container itself is identical to that described with respect to FIG. 1, except for the addition of this embodiment 10 of the opening device which is generally fabricated of a length of flexible cord and includes a first portion 16 which, as best seen in FIG. 4, is adhered along fold F (or E) of the inner surface H of the pour spout. The adhesion means is preferably an instant or "super" glue; however, other well-known adhesives would also be suitable. Additionally, manufacturers of these containers which utilize a wax-coated paper amy devise ways to embed and attach this first portion 16 directly into the surface of these wax-coated papers.

The first portion 16 extends at 14 our from between the sealed-together upper margins P/R and Q/S of the pour spout, this segment of cord 14 also being sealed there between. Exposed finger loop 12 is formed by knot 18.

To use this embodiment 10 of the invention C', as seen in FIG. 2, loop 12, adapted to receive the user's finger, is pulled in the direction laterally away from the pour spout in the direction of the arrow. By doing so, the first portion 16 and its extension 14 separate the mating, sealed upper margins of the pour spout at P/R and Q/S from one another. It is intended at this stage of the opening process that first portion 16 remain adhered to the inner surface of the pour spout as shown. However, referring to FIG. 3, once the pour spout is opened, providing opening N for pouring liquids from the container, the entire opening device 10 may be made to be removable therefrom by pulling loop 12 in the opposite direction of the arrow shown in phantom. This detachability should be easily understood on the basis that the adhesive means which bonds the first portion 16 to the inner surface of panel H is typically extremely strong in preventing shearing forces (those parallel to the attaching surface) from dislodging the invention 10 therefrom. However, by applying finger pressure inwardly in the direction of the arrows against edges B & D, the user may, by pulling loop 12 laterally inwardly and away from the inner surface of the panel H, create a generally perpendicular tearing or peeling force which easily detaches the first cord portion 16 from the inner surface of the pour spout. Alternately, loop 12 may simply be cut with a knife or sizzors along upper pour spout margin L/M.

Referring now to FIGS. 5, 6 and 7, the container shown in FIG. 1 is there shown at C" including the preferred embodiment of the opening device 20. The opening device 20 includes a triangular-shaped thin panel 22 having adhesive on one side so as to render it attachable to the inner surface of panel H of the pour spout as shown. The device 20 extends upwardly narrowing at area 24 and exiting from between pour spout upper margins P/R and Q/S in sealed fashion there between, outwardly extending beyond margin L/M to form finger-receiving loop 26.

Again, to quickly open the sealed pour spout, the user simply inserts a finger into loop 26 as shown and pulls same laterally away from the pour spout in the direction of the arrow in FIG. 5. This exerts a tearing or peeling force perpendicular to the sealed mating surfaces P/R and Q/S of the pour spout, easily separating same into the configuration of the pour spout shown in FIG. 6.

Although loop 26 may be deformed and pushed aside against one of the outer surfaces of the pour spout or alternately may be cut with a knife or sizzors along upper pour spout margin L/M, the preferred embodiment 20 is made easily detachable once the pour spout is initially opened. By exerting opposing inward finger pressure in the direction of the arrows along edges B and D to hold the pour spout in its open configuration shown in FIG. 6, the user may, by grasping loop 26, pull it laterally inwardly in the direction of the arrow. By doing so, a perpendicular tearing or peeling force is exerted between the adhesive surface of triangular portion 22 and the inner surface of panel H. By this action, while so restraining the pour spout in its open configuration, the entire opening device 20 is thus rendered removable.

It should be understood that in this embodiment 20 of the opening device, as well as that previously described, i.e. at numeral 10 in FIGS. 2 to 4, adhesive means utilized to adhere the first portion of the opening device against the inner surface of panel H is adequately strong to effect opening of the pour spout as previously described whereby a hearing-type force is placed on the adhesive interface therebetween. However, in removing the opening device 10 or 20 once the pour spout has been initially opened, the described removal force exerts a perpendicular tearing or peeling or force with respect to this adhesive interface rendering these devices 10 and 20 easily removable.

Referring lastly to FIGS. 8 and 9, another embodiment of the invention is shown generally at C''' including the same container C as described with respect to FIG. 1 and also including opening device 30. This embodiment 30 of the opening device is somewhat different than the two previously described in that it is intended to exert a shearing force to slice through the sealed mating surfaces P/R and Q/S of the upper margins of the pour spout. This embodiment 30 is fabricated of a length of flexible cord having its first portion 36 disposed transversely along and inwardly adjacent the sealed regions P/R and Q/S of the pour spout. End segment 38, upwardly extending as shown within and along margin D, is provided for enhanced functioning and removal of the opening device 30. Cord segment 34 upwardly extends along margin E as shown and exits from between the sealed panels P/R and Q/S of the pour spout as shown and is integrally formed with finger loop 32.

In use, once the initial or first stage of opening the container C''' is effected conventionally as previously described to place the pour spout in the configuration shown in FIG. 8, the user simply inserts a finger into loop 32 and upwardly pulls same in the direction of the arrow and generally within the plane of the still-closed pour spout. By exerting this force, the first portion 36 easily shears or slices through the sealed-together panels P/R and Q/S of the pour spout.

As shown in FIG. 9, once the substantial portion of the sealed surfaces P/R and Q/S have been sliced through, the pour spout may be opened by squeezing inwardly in the direction of the arrows against margins B and D. Thereafter, the entire opening device 30 may be detached from within the pour spout and finally along 38.

While the instant invention has been shown and described herein in what is concerned to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. In a conventional rectangularly shaped liquid container for milk, juice and the like, having four upstanding sides sealed along their mating upper margins to form a container top, said container formed of folded, thin sheet paper or plastic and having a four sided pour spout formed when said container top is opened for use, with two of said four sides of said pour spout formed by folding in an upper portion of one of the four upstanding sides to form an inner triangular panel having an inside surface and attached to said one side along a fold line, the improvement comprising:

a container opening device having a first portion adhesively connected to said inside surface of said inner triangular panel and extending to said pour spout and a second portion integral with said first portion and extending freely from a juncture between said two sides of said pour spout structured to be hand-grasped and pulled;

said first portion adapted, when said second portion is pulled laterally away from said pour spout, to forceably separate said sealed, mating upper margins of said container top.

2. An improved liquid container as set forth in claim 1, wherein:

said first portion is a length of cord adhered within said pour spout onto said inside surface of said triangular panel;

said second portion is a loop of said cord adapted for finger insertion therethrough.

3. An improved liquid container as set forth in claim 2, wherein:

said first portion is detachable from said pour spout by pulling said second portion laterally away from said pour spout inner surface while holding said pour spout in its open position.

4. An improved liquid container as set forth in claim 1, wherein:

said first portion is a sheet of flexible tape having an adhesive on one surface adapted to be adhered onto said inside surface of said triangular panel;

said second portion is a loop formed by an elongated, narrowed extension of said first portion adapted for finger insertion therethrough.

5. An improved liquid container as set forth in claim 4, wherein:

said first portion is detachable from said pour spout inner surface by pulling said second portion laterally away from said pour spout inner surface while holding the said pour spout in its open position.

* * * * *